US005929402A

United States Patent [19]

Charles et al.

[11] Patent Number: 5,929,402

[45] Date of Patent: Jul. 27, 1999

[54] SWITCHABLE LOAD COIL CASE INCLUDING MULTIPLE CIRCUIT ROTARY SWITCH ASSEMBLY

[75] Inventors: Joseph T. Charles, Inverness; Steven D. Evans, Algonquin; Gerald A. Greco, Elk Grove Village; Walter T. Harwood, Streamwood; Eduardo Leon, Hanover Park; Steven P. Moehling, Crystal Lake; Ronald Washburn, Marshall, all of Ill.

[73] Assignee: Charles Industries, Ltd., Rolling Meadows, Ill.

[21] Appl. No.: 08/753,797

[22] Filed: Nov. 29, 1996

[51] Int. Cl.[6] ..... H01H 19/58; H01H 9/04

[52] U.S. Cl. ..... 200/11 R; 200/11 G; 200/302.1

[58] Field of Search ..... 200/11 R–11 TW, 200/1 U, 17 R, 18, 302.1–302.3; 178/46; 336/65; 323/340–356

[56] References Cited

U.S. PATENT DOCUMENTS

| | | | |
|---|---|---|---|
| 2,360,801 | 10/1944 | Steinmayer et al. | 200/302.1 X |
| 3,255,319 | 6/1966 | Paine | 200/302.1 X |
| 3,316,363 | 4/1967 | Valdettaro et al. | 200/302.1 X |
| 3,470,333 | 9/1969 | Schneider et al. | 200/11 G X |
| 3,855,521 | 12/1974 | Kiuchi | 200/11 G X |
| 3,865,980 | 2/1975 | Moser et al. | 178/46 |
| 3,988,707 | 10/1976 | Moser et al. | 336/65 |
| 4,172,964 | 10/1979 | Reinebach | 178/46 |
| 4,260,853 | 4/1981 | Charles | 178/46 |
| 4,433,208 | 2/1984 | Noetzelmann, Sr. | 178/46 |
| 4,558,189 | 12/1985 | Dibbern, Jr. et al. | 200/1 V |
| 5,010,214 | 4/1991 | Yamazaki | 200/11 G X |

OTHER PUBLICATIONS

Brochure of Coil Sales & Manufacturing Company, a Charles Industries company, on Load Coil—"Highest Performance Load Coil for Uninterrupted Reliability"; Aug. 1996.

Brochure of Coil Sales & Manufacturing Company, a Charles Industries company, on "Universal Case" for universal load coil cases; Jan. 1993.

*Primary Examiner*—J. R. Scott

*Attorney, Agent, or Firm*—Leydig, Voit & Mayer, Ltd.

[57] ABSTRACT

A switchable load coil case is provided having a switch assembly connected to the load coil and incoming and outgoing wire pair. The switch assembly has a switch actuator disposed in a terminal housing cavity movable between loaded and bypass positions. The switch assembly has contacts which connect the load coil in series with the incoming and outgoing wire pair when the switch actuator is in the loaded position and connect the incoming and outgoing wire pair while bypassing the load coil when the switch actuator is in the bypass position.

18 Claims, 7 Drawing Sheets

SWITCHABLE LOAD COIL CASE INCLUDING MULTIPLE CIRCUIT ROTARY SWITCH ASSEMBLY

FIELD OF THE INVENTION

The present invention relates generally to a load coil case for terminating loads and, more particularly, to a switchable load coil case.

BACKGROUND OF THE INVENTION

In data and voice transmission lines typically used in the telephone industry, the cable consists of a plurality of wire pairs, typically segregated into groups of 50, 100, 200, 400, 600, 1200 or 1800 pairs, which are covered by a pressurized and air-tight metallic sheath and a plastic outer protective sheath. Wire pairs extending between a central source and a subscriber have substantial capacitance, resulting in a change in impedance with length. The capacitance effect of the cable conductors has a direct relation on the voice band (300 Hz to 3000 Hz) from any given point—the higher the frequency, the greater the loss or attenuation. Thus, it is conventional to connect inductance or load coils in the conductors to maintain a predetermined impedance to balance and improve the voice frequency characteristics of the cable conductors and to assure maximum signal power transfer between the central source and the subscriber. The load coils are typically connected to wire pairs at predetermined intervals so that the known capacitance of the resulting predetermined wire pairs will be balanced by the inductance of the load coil.

Load coil cases are typically used for housing the plurality of load coils associated with each of the 50, 100, 200, 400, 600, 1200 or 1800 wire pairs. After the individual wire pairs are connected to a corresponding load coil, they are typically assembled in a compact configuration in the load coil case and the load coil case is filled with an appropriate encapsulating or potting compound to keep moisture from affecting the load coils, such as by oxidizing the metallic inductor cores, damaging the insulation of the wires in the load coil, or forming conductive paths between wire pairs which would result in degraded compensation and cross linking and cross talk between wire pairs. The load coil may then be stored in pedestal cabinets, in underground manholes, and the like.

In many applications, however, when the subscriber wants high frequency service, each and every load coil located between the source and subscriber must be "unloaded" or bypassed from the wire pair servicing the particular subscriber. In order to bypass the load coil, each load coil case must first be located in the dirt, water, and other debris typically found in the outside plant telephone environment. After the outer and metallic sheaths are removed and the specific wire pair servicing the subscriber is located from the potentially hundreds of wire pairs typically found in telecommunications cables, the load coil is unloaded or bypassed by splicing the wire pair around the load coil. The cable must be recovered with the metallic and plastic sheaths, pressurized and tested for leaks. It will be appreciated that a subscriber may alternatively require that a disconnected load coil be re-loaded or re-connected to the wire pair in a similar manner. In either case, it may typically take two technicians eight hours or more to complete the splicing operation for each load coil in the subscriber's wire pair.

SUMMARY AND OBJECTS OF THE INVENTION

Accordingly, it is an object of the present invention to provide a novel load coil case which permits a load coil to be easily and selectively loaded into the circuit and unloaded or bypassed from the circuit.

A related object of the present invention is to provide a load coil case having a switch assembly which may be adapted to accommodate any number of wire pairs and load coils.

A further object of the present invention is to provide a switch assembly which may be easily and quickly assembled. A related object is to provide a switch assembly to which a load coil and wire pairs may be easily and quickly assembled.

It is another object of the present invention to provide a novel switch actuator which permits contacts to be electrically separated in a small package.

Yet another object of the present invention is to provide a switchable load coil case which is adapted for use in hostile environments such as, for example, underground, under water or other wet conditions.

These and other features and advantages of the invention will be more readily apparent upon reading the following description of a preferred exemplified embodiment of the invention and upon reference to the accompanying drawings.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 2:
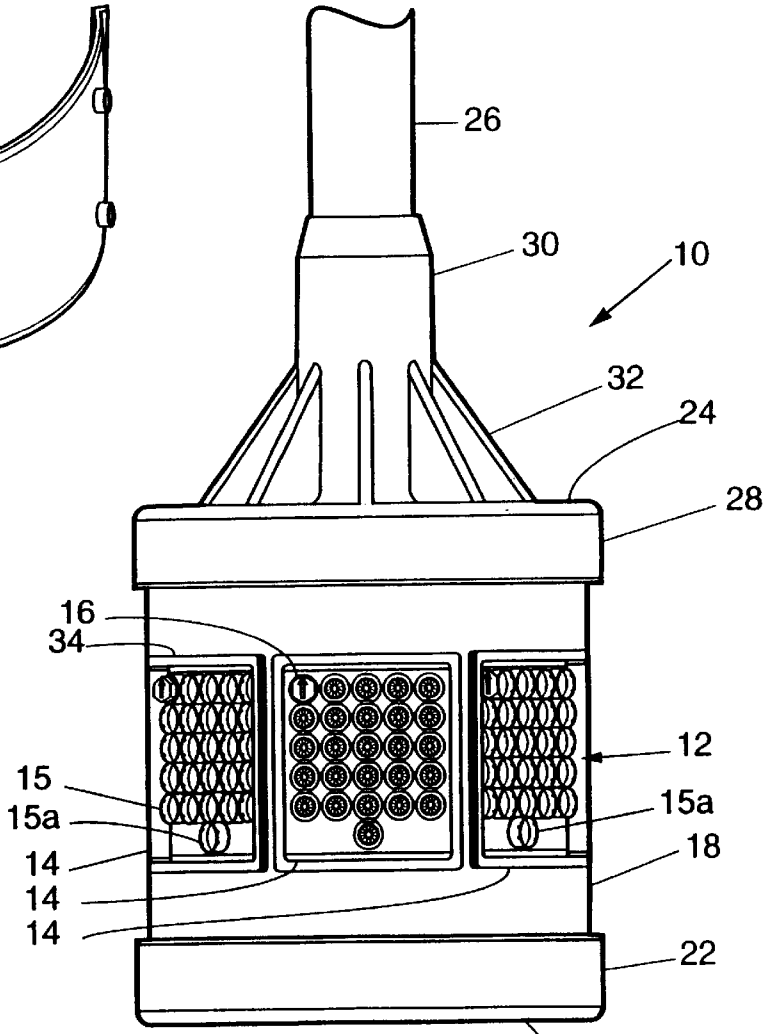
FIG. 2 is an elevational view of the switchable load coil case in FIG. 1.
Figure 1:
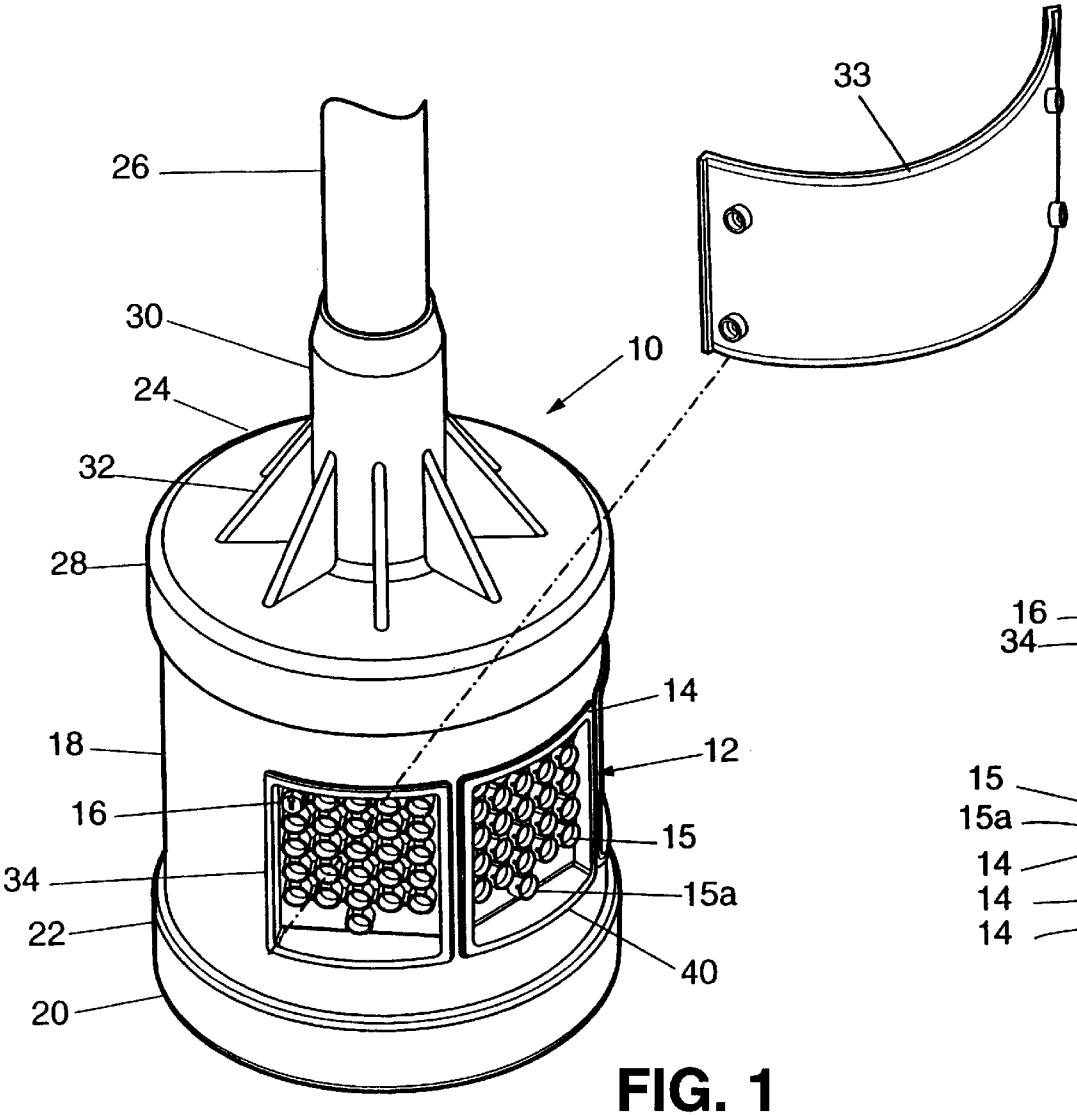
FIG. 1 is a perspective view of a switchable load coil case including its over plate in accordance with the present invention.

Turning to the figures, FIGS. 1–2 illustrate one embodiment of a switchable load coil case 10 in accordance with the present invention incorporating three switch assemblies 12. The switchable load coil case 10 includes a generally cylindrical housing 18 formed of a suitable material such as, for example, polyethylene, polyvinyl chloride plastic, and the like for providing protection against adverse weather conditions, water infiltration, corrosive environments and the like. One end of the housing 18 is closed with a generally circular end cap 20 having a depending skirt 22 dimensioned for air and water-tight sealing engagement with the end of the housing 18. The other end of the housing 18 has a generally cylindrical cable entrance cap 24 for receiving the stub end of a communication cable 26. The entrance cap 24 has a skirt 28 dimensioned for air and water-tight sealing engagement with the housing 18, a strain relief neck 30, and a plurality of reinforcing ribs 32.

As is conventional, the communication cable 26 has a plurality of incoming electrical leads or conductor pairs (generally designated 100 and 102 in FIG. 9) and outgoing wire pairs (generally designated 104 and 106 in FIG. 9) surrounded by a protective metallic sheath (not shown) and encased within an outer protective plastic sheath (not shown). The entrance cap 24 is dimensioned for air and water-tight sealing engagement with the outer plastic sheath of the cable 26. A plurality of conventional load coils (generally designated 107 in FIG. 9) corresponding to each wire pair is located in the load coil case 10 wherein each load coil 107 has a pair of incoming leads generally designated 108 (or Tin-coil) and 110 (or Rin-coil) and a pair of outgoing leads generally designated 112 (or Tout-coil) and 114 (or Rout-coil). Although any type of conventional load coil may be used, a bifilar wound 66 or 88 mH coil has been found to be suitable.

In accordance with certain objects of the invention, at least one switch assembly 12 is provided for selectively loading or bypassing the load coil 107 associated with each wire pair. The switch assembly 12 may comprise at least one switching block 14 for holding at least one terminal housing 15 adapted for receiving a corresponding rotary actuator or switch 16. Each terminal housing 15 is connected to one of the incoming and outgoing wire pairs and a corresponding load coil 107. In the embodiment illustrated in FIGS. 1–2, the load coil case 10 has three switch assemblies 12 disposed in corresponding housing apertures generally designated 34. Each load coil case 10 has a cover plate 33 (shown in FIG. 1) which may be releasably attached to the switching block 14 using screws, bolts and the like (not shown) for covering and protecting the terminal housings 15 from dirt and impact damage and the like.

Figure 4:
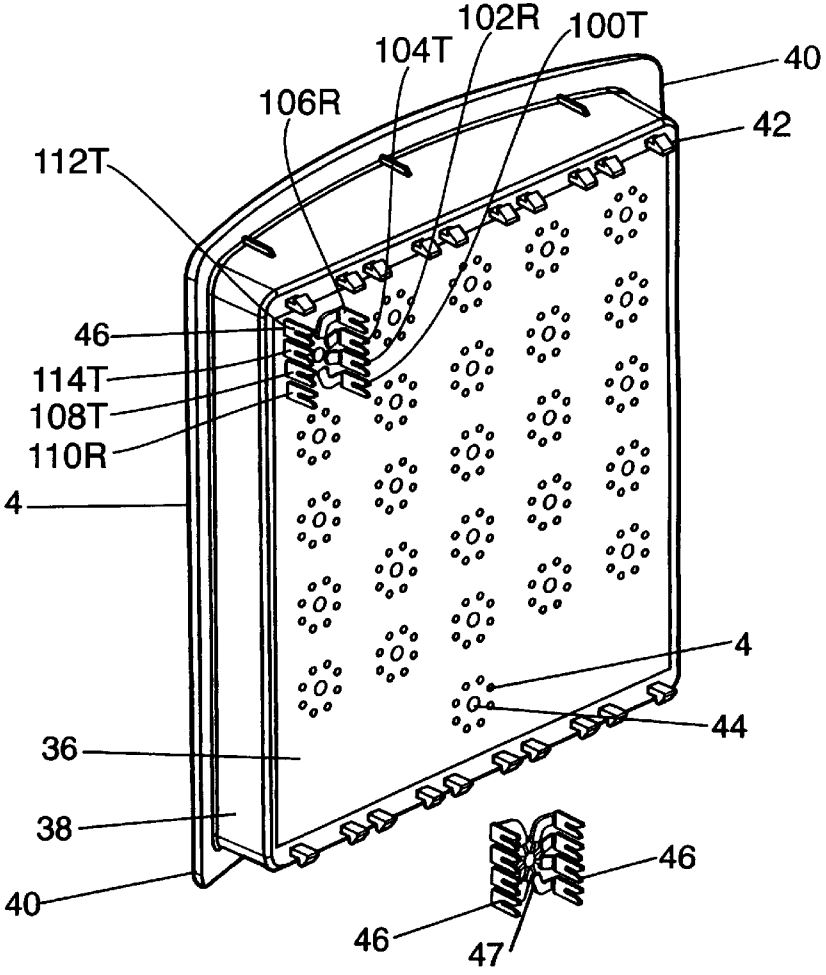
FIG. 4 is a rear perspective view of the switching block in FIG. 1.
Figure 3:
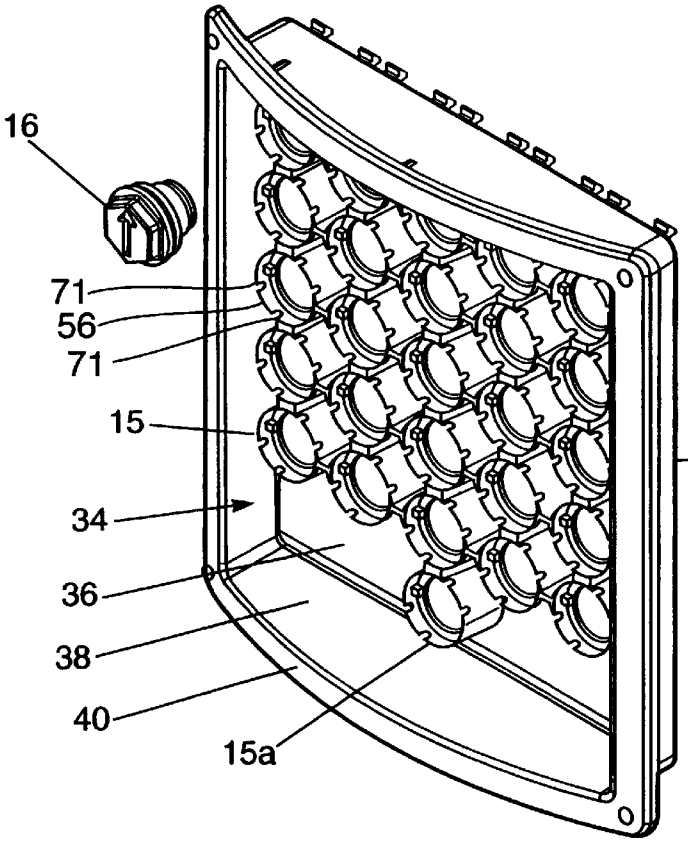
FIG. 3 is a front perspective view of a switching block shown in FIG. 1.
Figure 8:
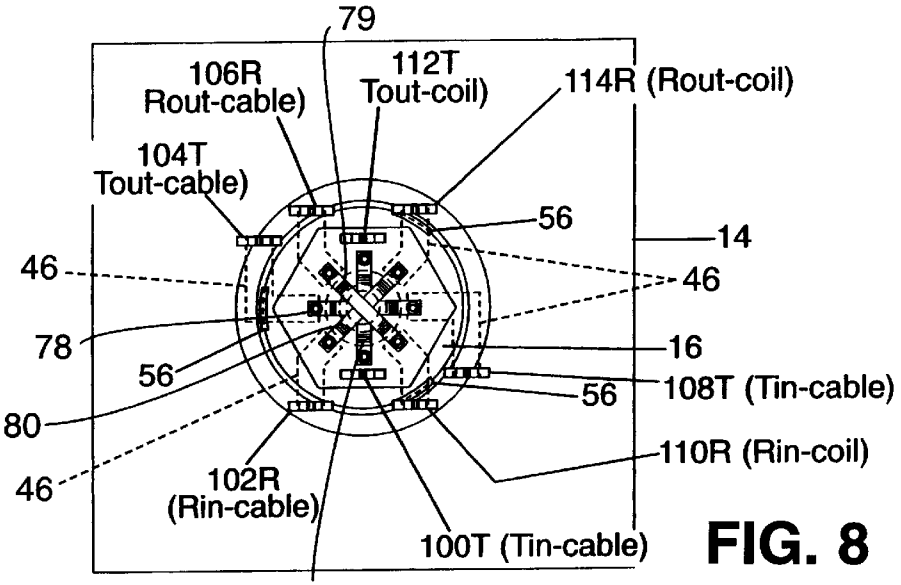
FIG. 8 is a schematic representation of FIG. 7 showing the terminal housing and switch actuator contact orientation.

As best shown in FIGS. 3 and 4, the switching block 14 has a recess 35 defined by a base 36 and side walls 38 for receiving the switch actuators 16 and an outwardly projecting shoulder 40 for limiting insertion of the switching block 14 into the housing 18. The switching block 14 may also have a plurality of engagement members 42 for holding the block 14 in the housing aperture 34 until a thermoplastic weld or other conventional air and water-tight seal may be formed between the shoulder 40 and the peripheral edge of the aperture 34 for eliminating air, dirt and contaminant infiltration into the load coil case 10. The illustrated embodiment of the switching block 14 has a rectangular configuration but may have any other configurations and dimensions adapted for sealably engaging the aperture 34. Although the switching block 14 and the terminal housings 15 may be separately manufactured and assembled together by injection over molding, they are preferably integrally molded from suitable materials such as thermoplastic.

The switching block 14 may have any number of terminal housings 15, but the illustrated switching block 14 preferably has at least twenty-five (25) terminal housings 15 and a spare terminal housing **15*a* for use in the event one of the other 25 terminal housings are damaged during manufacture or assembly. Thus, the switchable load coil case 10 may be adapted to receive an appropriate number of switching blocks 14 to accommodate a predetermined number of wire pairs such as, for example, the 50, 100, 200, 400, 600, 1200, 1800 wire pairs, typically used in the telephone industry. The illustrated switchable load coil case 10 has, for example, three switching blocks 14** for accommodating 75 load coils.

Figure 14:
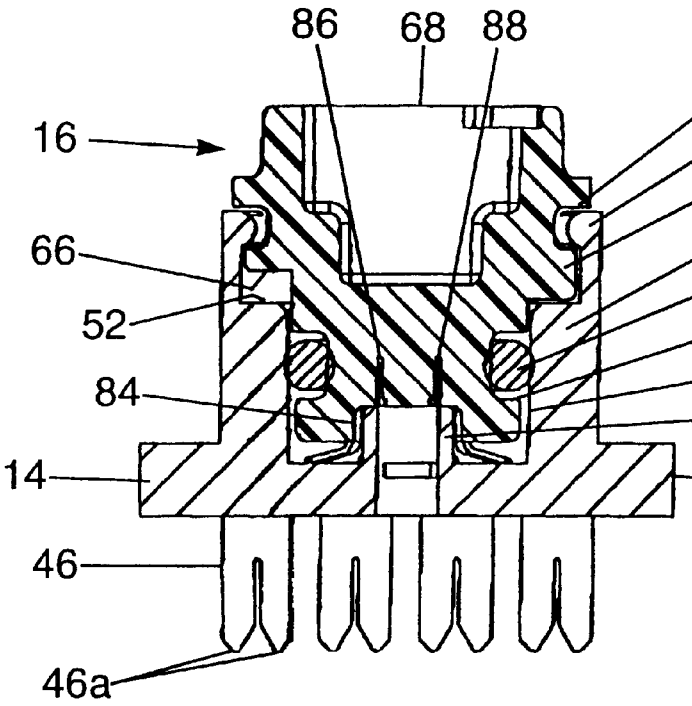

Referring to FIG. 4, it will be seen that each terminal housing 15 has eight IDC contacts 46 that are insert molded in the base 36 of the switching block 14, and a central punch hole generally designated 44. As best shown in FIG. 14, the IDC contact 46 has two opposing arms **46*a* which are spaced apart to receive a lead (not shown) wherein the arms 46*a* cut through the lead's insulation to electrically connect to the interior lead. During manufacture, the eight IDC contacts 46 are connected by a central portion 47 for ease of assembly. After the IDC contacts 46 are inserted into the eight bore holes 43, a tool may be inserted into the punch hole 44 for removing the central portion 47 and electrically separating the eight individual contacts 46**. Although any suitable IDC contact may be used, the IDC contacts preferably are capable of terminating 24–30 gauge wire.

Figure 7:
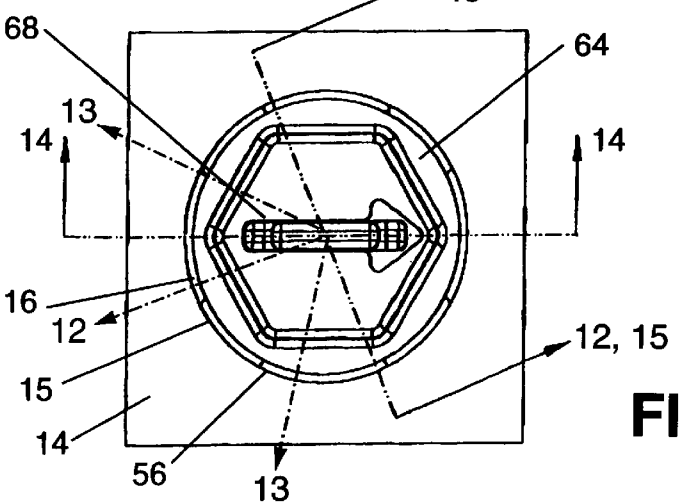
FIG. 7 is a top view of the switch in a terminal.
Figure 15:
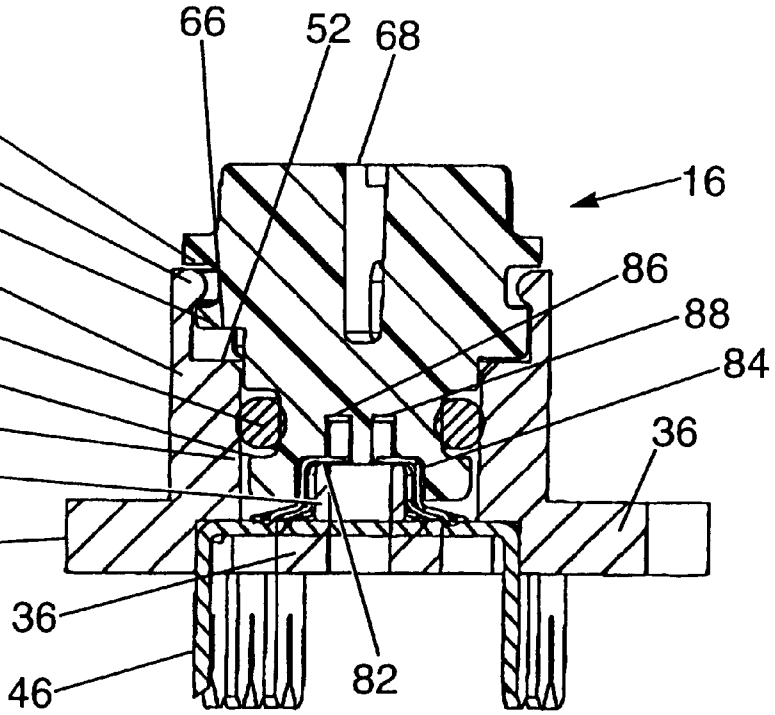

For ease of reference, a single representative terminal housing 15, a corresponding switch actuator 16 and a portion of the switching block base 36 are shown in FIGS. 6–7 and 14–15. For receiving a switch actuator 16, each terminal housing 15 has a cavity 48 defined by the base 36 and an upwardly projecting circular wall 50. Referring to FIGS. 7 and 14–15, it will be seen that the IDC contacts 46 pass through the switching block base 36 into the terminal cavity 48 for electrical connection with the switch actuator 16. The cavity wall 50 defines a protrusion 58 which provides the bearing surface for switch actuator 16 and limits insertion of the switch actuator 16 into the cavity 48, and also assists in properly aligning the switch actuator 16 in the terminal housing 15. The cavity wall 50 also defines a shoulder 52, a key 54 for insuring proper alignment and controlling rotation of the switch actuator 16 in the terminal housing 15, and at least one inwardly projecting undercut 56 for capturing the switch actuator 16 in the terminal housing 15 while permitting controlled and selective rotation of the switch actuator 16 in the terminal housing 15.

Referring to FIGS. 5–8, it will be seen that the switch actuator 16 has a head portion 60 and an outwardly projecting body portion 62. The head 60 has a shoulder 64 dimensioned to rotatably engage the shoulder 52 of the cavity 48. The shoulder 64 has an undercut 66 for cooperatively engaging the terminal housing key 54 for insuring proper alignment and insertion of the switch actuator 16 relative to the terminal housing 15. In accordance with certain objects of the invention, the undercut 66 is defined by first and second sidewalls **66*a*, 66*b* for permitting selective rotation of the switch actuator 16 between a loaded position and an unloaded or bypass position. In the loaded position, the terminal housing 15 connects the load coil 107 with the incoming and outgoing wire pairs. In the unloaded or bypass position, the terminal housing 15 and switch actuator 16 bypass the load coil 107, thereby "unloading" the load coil 107 and connecting the incoming and outgoing wire pairs. The switch head 60 preferably has a screwdriver slot 68 and/or hex head for assisting rotation of the switch actuator 16 between the loaded and bypass positions. It is also preferable that the actuator head 60 have an arrow generally designated as 70** or other reference for indicating the loaded and unloaded positions.

Figure 6:
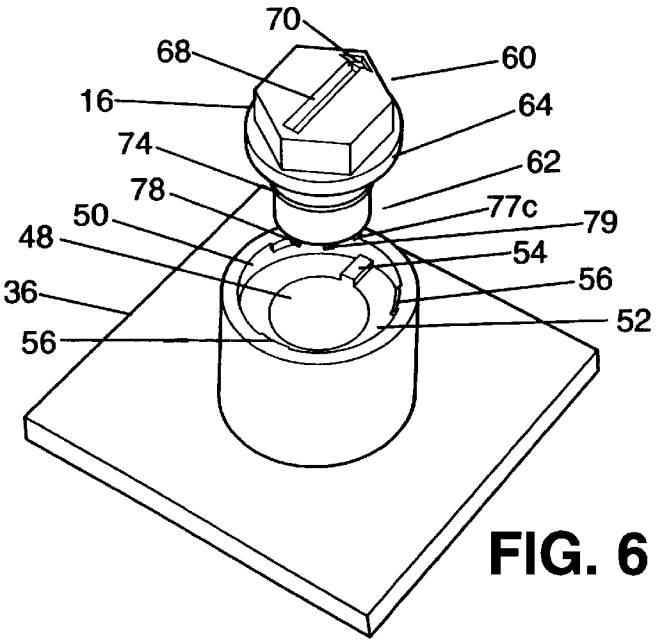
FIG. 6 is an exploded view of the switch and an individual terminal of the switching block.
Figure 13:
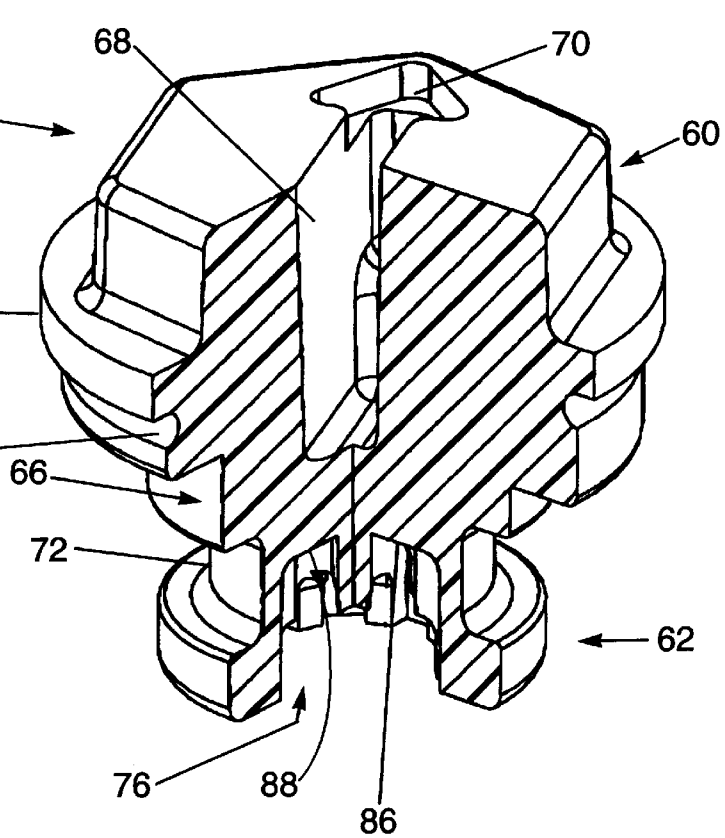
FIGS. 12–15 are sectional views taken along lines 12—12, 13—13, 14—14, and 15—15 in FIG. 7, respectively, showing the vertical orientation of the short and tall slots in the actuator switch for receiving the switch contacts.
Figure 12:
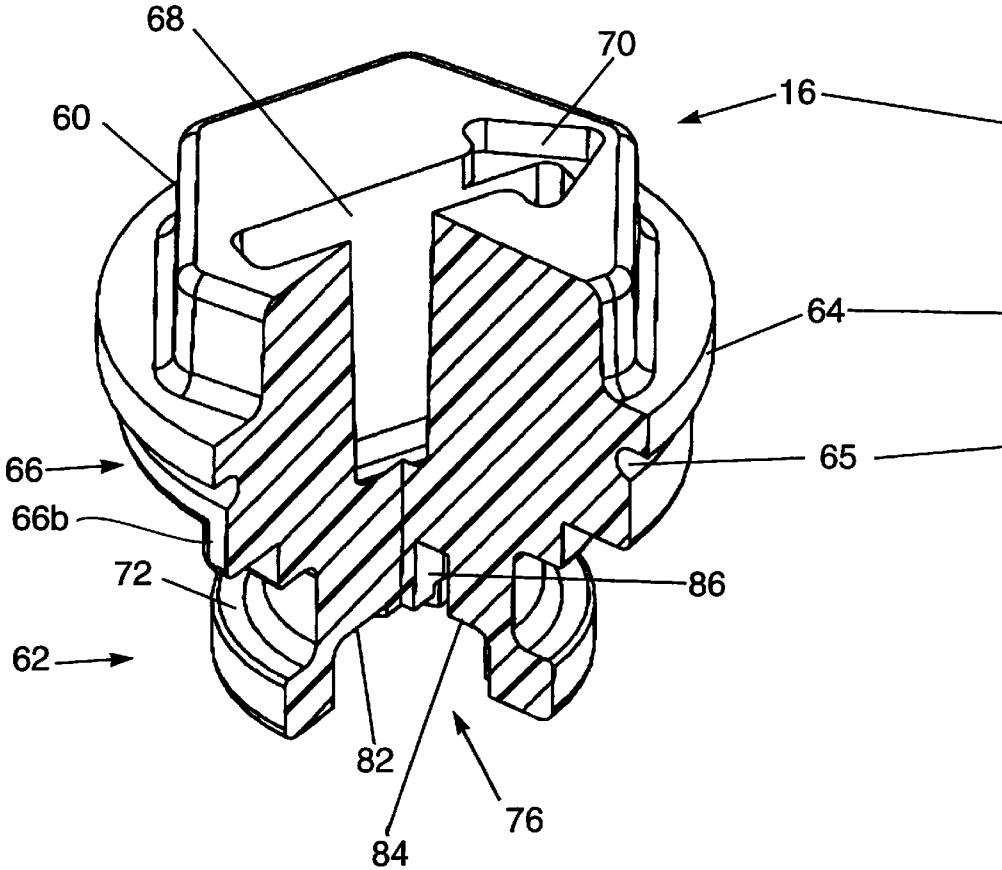

Means for locking the switch actuator 16 in the terminal housing 15 is provided. In the illustrated embodiment, the locking means comprises at least one undercut 56 adapted for resiliently deflecting in response to the insertion of the switch actuator 16 into the cavity 48 and subsequently engaging the groove 65 of the shoulder 64 as best shown in FIGS. 12–13. In order to increase the flexibility of the cavity wall 50 and permit the undercuts 56 to deform in response to the switch actuator 16, the wall 50 may have a plurality of slots 71 as shown in FIG. 3. The biasing force of the actuator contacts pushes the actuator outwardly into snug engagement with the undercut 56. It will, of course, be appreciated that other locking means will be known to those skilled in the art such as permitting the undercuts 56 to engage the top of the shoulder 64 as shown in FIG. 6, or providing vertical grooves in the side of the shoulder 64 which permit the switch head 60 to be inserted past the inwardly projecting undercuts 56 so that, upon subsequent rotation of the switch actuator 16, the undercuts 56 lockingly engage the top of the shoulder 64.

Figure 5:
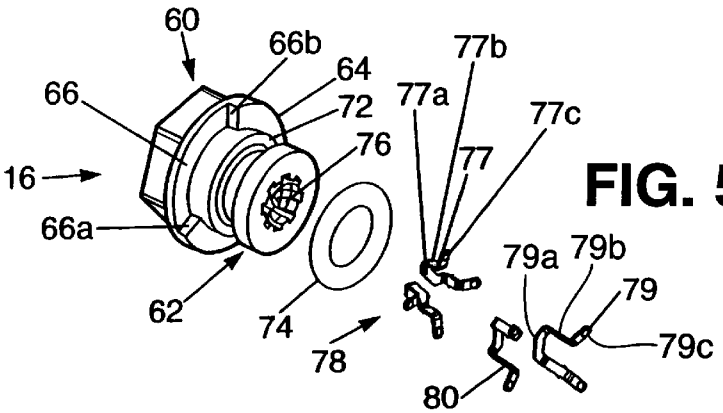
FIG. 5 is an exploded view of a rotary actuator or switch.
Figure 11:
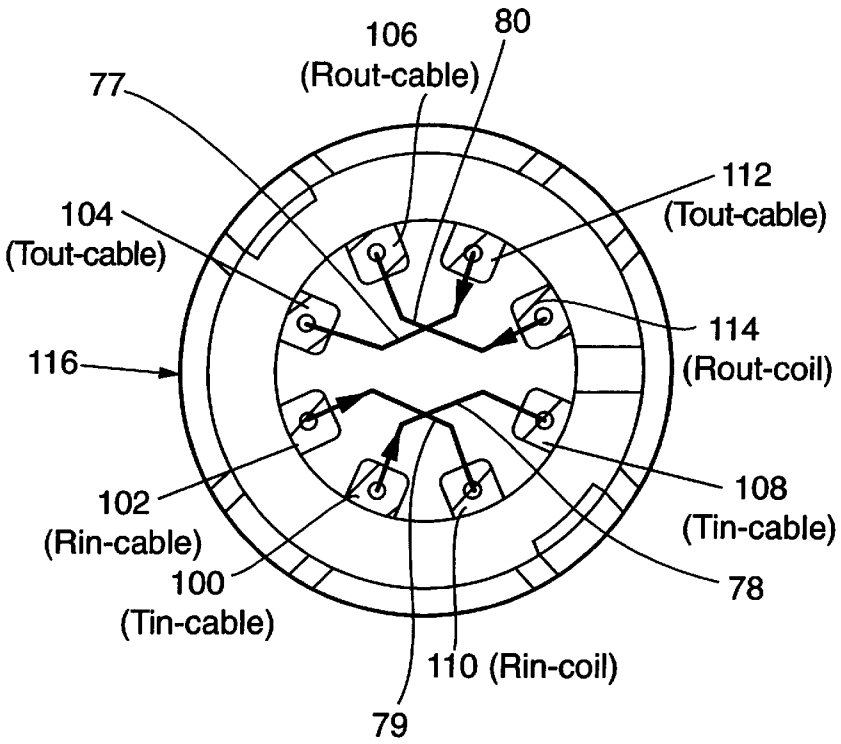
FIG. 11 is a schematic diagram of the switch in the loaded position showing the current path in solid lines.
Figure 10:
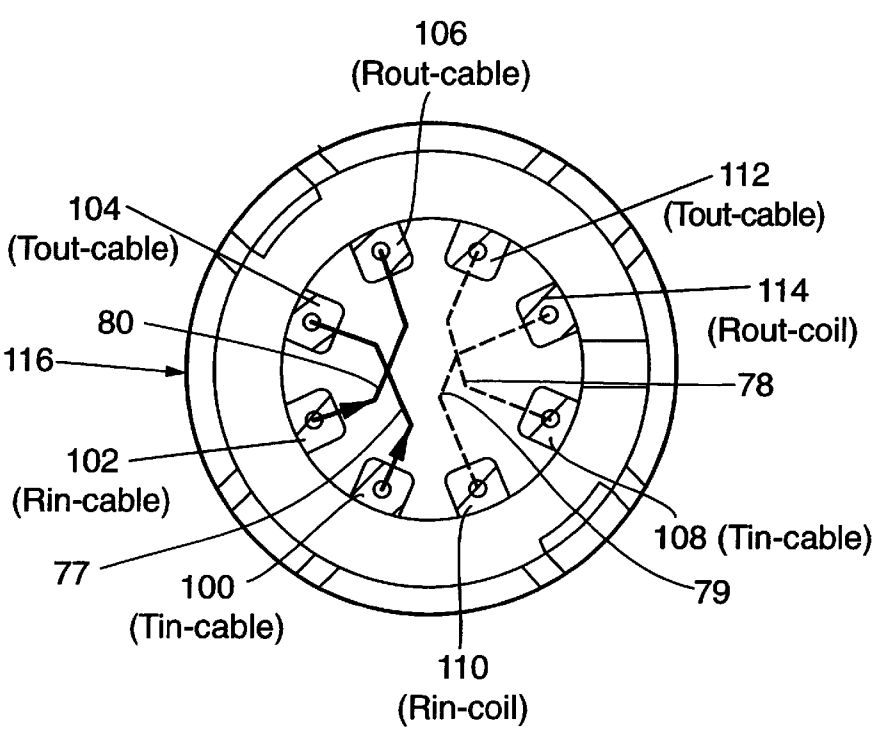
FIG. 10 is a schematic diagram of the switch in the bypass position showing the current path in solid lines.

Referring to FIGS. 5 and 12–15, a channel 72 extending around the periphery of the switch body 62 is adapted to receive an O-ring 74 for creating an air-tight seal between the switch actuator 16 and the terminal housing wall 50. In order to minimize or eliminate shorting between the switch contacts 77–80 and the block contacts 46 during surges and the like, non-conductive or dielectric grease may also be inserted into the cavity 48 prior to switch actuator 16 insertion. The switch body 62 has a centrally located hole 76 for receiving the base protrusion 58 and a plurality of switch contacts 77, 78, 79, 80 which provide eight (8) points of contact. In order to receive the switch contacts, the hole 76 has four slots 82, 84, 86, 88 for receiving a corresponding contact. FIGS. 10–11 are schematic diagrams showing the orientation of the four contacts 77, 78, 79, 80 inserted into their respective slots 82, 84, 86, 88, respectively. In order to electrically separate each switch contact 77, 78, 79, 80 in the relatively small switch body 62, two pairs of opposing slots 82/84 and 86/88 are disposed at different depths. FIGS. 12–15 are sectional views showing one of the short slots 84 disposed at a first depth and one of the other tall slots 86 disposed at a second or larger depth in order to insure that adjacent contacts 78 and 79 (or 77 and 80) disposed in each of the four slots are electrically separated from each other. Referring to FIGS. 5 and 6, contact 77, for example, has a body portion 77*a* for engaging the slot 82, a perpendicular arm portion 77*b* for projecting out of the slot 86 and, a perpendicular tail portion 77*c* for projecting around the periphery of the hole 76 for engaging the terminal housing contacts. The other contacts 78–80 also have similar body, arm and tail portions.

Figure 9:
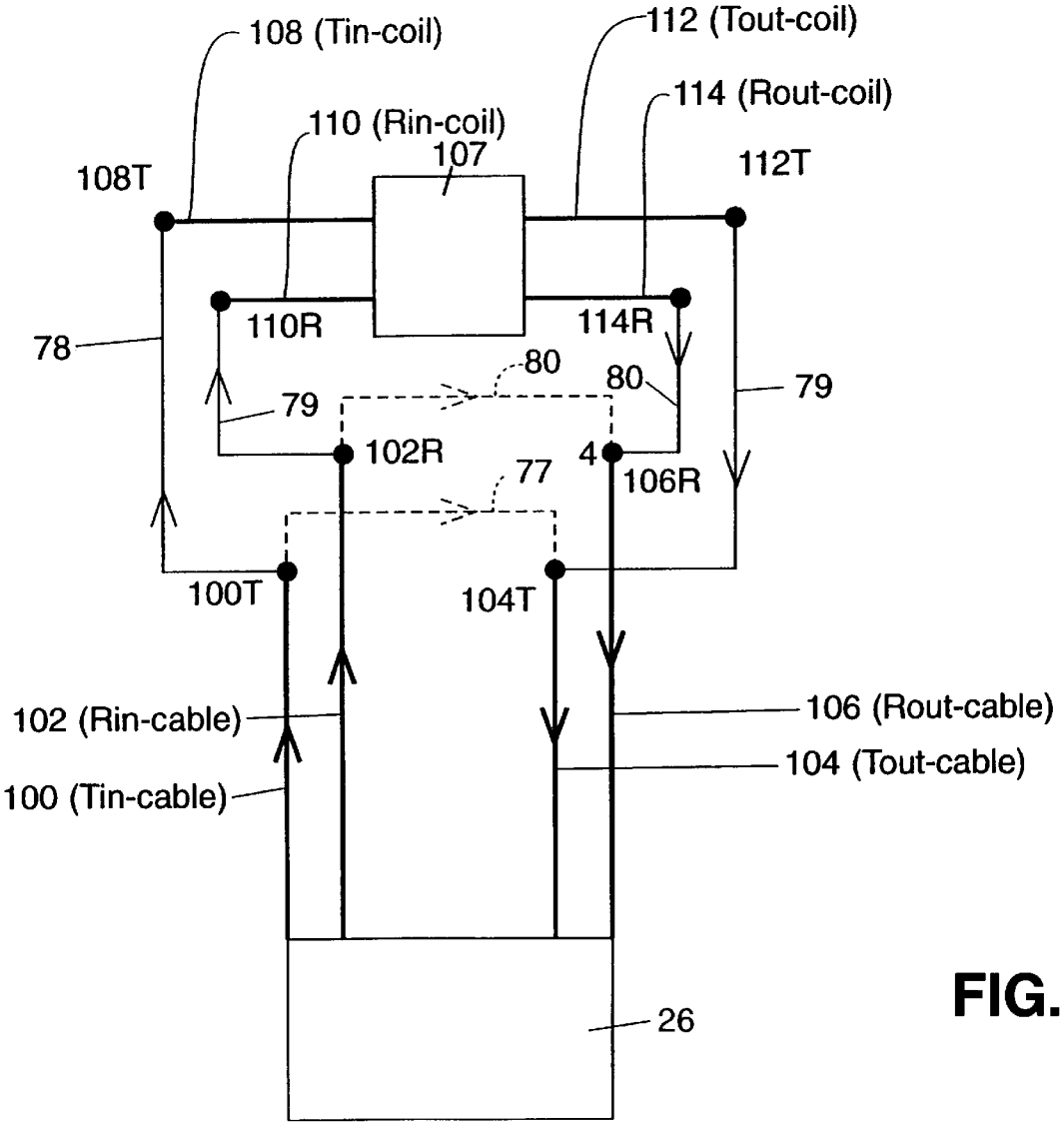
FIG. 9 is a switching schematic diagram of the switching assembly showing the bypass or unloaded mode in broken lines and the loaded mode in solid lines.

FIG. 9 illustrates a switching schematic diagram of each terminal housing 15. Each terminal housing 15 has a corresponding incoming wire pair designated 100 (or Tin-cable) and 102 (or Rin-cable) and an outgoing wire pair 104 (or Tout-cable) and 106 (or Rout-cable) from the cable stub 26. Each terminal housing 15 has a corresponding load coil 107 having an incoming wire pair designated 108 (or Tin-coil) and 110 (or Rin-coil) and an outgoing wire pair designated 112 (or Tout-coil) and 114 (Rout-coil). In FIG. 9, each lead 100, 102, 104, 106, 108, 110, 112, 114 has a respective contact 100T, 102R, 104T, 106R, 108T, 110R, 112T, and 114R generally representing the electrical connection to one of the eight terminal housing contacts 46 on the rear of the switching block 14. And, as previously discussed, each switch actuator 16 has switch actuator contacts 77, 78, 79, 80. In accordance with certain objects of the invention, the switch assembly 12 selectively permits the incoming wire pair 100, 102 to: (1) be connected in series with the load coil 107 when the switch actuator 16 is in the loaded position as shown in solid lines in FIG. 9 or (2) bypass the load coil and be connected in series with the outgoing wire pair 104, 106 when the switch actuator is in the bypass position as shown in broken lines in FIG. 9.

FIGS. 10–11 are schematic diagrams showing the current path (in solid lines) in a representative terminal housing 15 and switch actuator 16 of the switch assembly 12 when the rotary switch actuator 16 is in the bypass position (FIG. 10) and the loaded position (FIG. 11). The schematic representation of the rotary switch actuator is generally designated 116 and as four switch contacts 77, 78, 79, 80, each switch contact having two points of contact. The eight contacts 100T, 102R, 104T, 106R, 108T, 110R, 112T, and 114R schematically represent the terminal housing contacts 46.

When the switch actuator 116 is in the bypass position as shown in FIG. 10, the switch contacts 77 and 80 connect the incoming wire pairs 100 (Tin-cable), 102 (Rin-cable) with the outgoing wire pairs 104 (Tout-cable), 106 (Rout-cable), respectively, permitting current carried by the incoming wire pairs 100, 102 to bypass the load coil 107. Referring to FIGS. 9 and 11, current flows through cable 100 (Tin-cable), contact 77, and cable 104 (Tout-cable). Similarly, current flows through cable 102 (Rin-cable), contact 80, and cable 104 (Rout-cable). Thus, the subscriber receives the desired high frequency signal unmodified by the load coil 107. It will be appreciated that, when the switch actuator 116 is in the bypass position, current passes through contacts 77, 80 (shown in solid lines) but not contacts 78, 79 (shown in broken lines).

When the switch 116 is rotated a quarter turn from the bypass position to the loaded position as shown in FIG. 11, the switch 116 connects the load coil 107 in series with the incoming wire pairs 100, 102 and the outgoing wire pairs 104, 106. Referring to FIGS. 9 and 11, current flows through cable 100 (Tin-cable), contact 78, coil lead 108 (Tin-coil), load coil 107, coil lead 112 (Tout-coil), contact 77, and cable 104 (Tout-cable). Similarly, current flows through cable 102 (Rin-cable), contact 79, coil lead 110 (Rin-coil), load coil 107, coil lead 114 (Rout-coil), contact 80, and cable 106 (Rout-cable). It should now be appreciated that, in accordance with the objects of the invention, the switch connects the incoming and outgoing wire cable pairs 100, 102, 104, 106 to the load coil leads 108, 110, 112, 114. In conventional load coil cases, however, the cable leads 100, 102, 104, 106 are typically connected directly to the load coil leads 108, 110, 112, 114, respectively, so that the incoming and outgoing wire pairs 100, 102, 104 and 106 must be physically cut from the load coil 107 and spliced together to bypass the load coil 107. In contrast, the switch assembly 12 of the present invention permits the load coil to be bypassed merely by rotating the switch actuator 16 to the unloaded or bypass position, thereby saving substantial time and expense.

In order to assemble the switchable load coil case 10, the required number of switch assemblies 12 are attached to the load coil case 10. In the illustrated embodiment, the load coil case has three switching blocks comprising 75 terminal housings 15 (and three spare terminal housings 15*a*). The IDC contacts 46 are insert molded to the base 36 and the central portion 47 is removed by inserting a tool into the punch hole 44. The individual wire leads 108, 110, 112 and 114 from the load coil 107, incoming wire pairs 100, 102 and outgoing wire pairs 104, 106, generally located within the housing 18, are terminated at their respective IDC contacts as schematically shown in FIGS. 10–11. The IDC contacts project through the base into the terminal housing cavity for subsequent electrical engagement with the switch contacts 77–80.

The rotary switch actuator 16 is assembled by attaching the O-ring 74 into groove 72 and by inserting the switch contacts 77–80 into their respective slots 82–88. In order to lock the switch actuator 16 in the terminal housing cavity, the undercut 66 is aligned with the cavity key 54 and the rotary switch actuator 16 is snapped past the undercuts 56 into the terminal housing cavity 48 which is filled with a non-conductive grease to minimize or eliminate shorting between the switch and terminal housing contacts. The switch actuator 16 may be rotated until one of the stopwalls 66*a*, 66*b* engages the key 54. The switching block 14 is inserted into the case aperture 34 and bonded to the peripheral edge of the aperture 34 to provide a water-tight seal. The cover plate 33 may also be attached to the case 10 to protect the terminal housing 15 located within the recess 35. The case 10 is then potted to protect the load coils 107 and IDC connections from damage. The outgoing wire pairs 106, 108 protruding from the cable stub 26 are available for subsequent connection to a main cable or a subscriber.

Thus it will be seen that a novel and improved switchable load coil case has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. A switchable load coil case comprising a housing for covering a load coil associated with an incoming and outgoing wire pair, and a switch actuator having contacts for selectively electrically connecting the load coil and incoming and outgoing wire pair, and wherein the switch actuator is movable between loaded and bypass positions and wherein the contacts of the switch actuator electrically connect the load coil in series with the incoming and outgoing wire pair when the switch actuator is in the loaded position and connect the incoming and outgoing wire pair while bypassing the load coil when the switch actuator is in the bypass position.

2. The switchable load coil case as set forth in claim 1 comprising at least one terminal housing to receive the switch actuator, the terminal housing having a plurality of contacts for selectively connecting the incoming and outgoing wire pairs and a plurality of leads from the load coil with the contacts on the switch actuator in response to positioning of the switch actuator between the loaded and bypass positions.

3. The switchable load coil case as set forth in claim 2 wherein the terminal housing comprises a cavity for rotatably receiving the switch actuator between the loaded and bypass positions wherein the switch actuator has an undercut defined by first and second stopwalls for cooperatively engaging a key in the cavity for limiting movement of the switch actuator between the first and second stopwalls and wherein engagement between the first stopwall and the key locates the switch actuator in the bypass position and engagement between the second stopwall and the key locates the switch actuator in the loaded position.

4. The switchable load coil case as set forth in claim 3 wherein the terminal housing cavity comprises a terminal housing shoulder for mating with a switch actuator shoulder for limiting insertion of the switch actuator into the cavity.

5. The switchable load coil case as set forth in claim 2 wherein the terminal housing comprises means for locking the switch actuator in the terminal housing in response to insertion of the switch actuator into the terminal housing.

6. The switchable load coil case as set forth in claim 5 wherein the locking means comprises at least one inwardly projecting undercut which resiliently deflects in response to insertion of the switch actuator into the terminal housing to lockingly engage the switch actuator.

7. The switchable load coil case as set forth in claim 2 wherein the switch actuator comprises a groove for receiving a seal for sealably engaging the terminal housing and forming an air-tight seal therebetween.

8. The switchable load coil case as set forth in claim 1 wherein the switch actuator comprises first and second pairs of opposing slots for receiving four corresponding contacts wherein the first pair of slots is disposed at a first depth and the second pair of slots is disposed at a second depth for electrically separating the contacts.

9. The switchable load coil case as set forth in claim 8 wherein the switch actuator contact has a body portion for engaging the slot and a projecting tail extending out of the slot for engaging the terminal housing contacts.

10. A switch assembly for use in a load coil case, the load coil case having a housing for covering a plurality of incoming and outgoing wire pairs, and a load coil associated with each incoming and outgoing wire pair, the switch assembly comprising a terminal housing associated with each load coil having a plurality of contacts electrically connected to the load coil and incoming and outgoing wire pairs, and a switch actuator in electrical connection with the terminal housing contacts and selectively movable between loaded and bypass positions wherein the switch actuator connects the load coil in series with the incoming and outgoing wire pair when the switch actuator is in the loaded position and the switch actuator connects the incoming and outgoing wire pair while bypassing the load coil when the switch actuator is in the bypass position.

11. The switch assembly as set forth in claim 10 wherein the terminal housing comprises a cavity for rotatably receiving the switch actuator between the loaded and bypass positions wherein the switch actuator has an undercut defined by first and second stopwalls for cooperatively engaging a key in the cavity for limiting movement of the switch actuator between the first and second stopwalls and wherein engagement between the first stopwall and the key locates the switch actuator in the bypass position and engagement between the second stopwall and the key locates the switch actuator in the loaded position.

12. The switch assembly as set forth in claim 11 wherein the terminal housing cavity comprises a terminal housing shoulder for mating with a switch shoulder for limiting insertion of the switch actuator into the cavity.

13. The switch assembly as set forth in claim 10 wherein the terminal housing comprises means for rotatably locking the switch actuator in the terminal housing in response to insertion of the switch actuator into the terminal housing.

14. The switch assembly as set forth in claim 13 wherein the locking means comprises at least one inwardly projecting undercut which resiliently deflects in response to insertion of the switch actuator into the terminal housing to lockingly engage the switch actuator.

15. The switch assembly as set forth in claim 10 wherein the switch actuator comprises a groove for receiving a seal for sealably engaging the terminal housing and forming an air-tight seal therebetween.

16. The switch assembly as set forth in claim 10 wherein the switch actuator comprises first and second pairs of opposing slots for receiving four corresponding contacts wherein the first pair of slots is disposed at a first depth and the second pair of slots is disposed at a second depth for electrically separating the contacts.

17. The switch assembly as set forth in claim 16 wherein the switch actuator contact has a body portion for engaging the slot and a projecting tail extending out of the slot for engaging the terminal housing contacts.

18. The switch assembly as set forth in claim 10 wherein the switch actuator has vertically spaced first and second slots for receiving corresponding first and second contacts wherein the first slot overlaps the second slot in the vertical direction.

* * * * *